US005319852A

United States Patent [19]

Metzger

[11] Patent Number: 5,319,852

[45] Date of Patent: Jun. 14, 1994

[54] LUBRICATING SAFETY RAZOR HOLDER

[76] Inventor: David A. Metzger, 511 Villa Dr., Belleville, Ill. 62223

[21] Appl. No.: 27,830

[22] Filed: Mar. 8, 1993

[51] Int. Cl.[5] ..... B26B 21/40; B26B 19/40

[52] U.S. Cl. ..... 30/90; 30/41

[58] Field of Search ..... 30/41, 41.5, 85, 90

[56] References Cited

U.S. PATENT DOCUMENTS

| | | | |
|---|---|---|---|
| D. 277,434 | 2/1985 | Iten | D6/526 |
| D. 294,903 | 3/1988 | Pokorny | D6/526 |
| 3,895,437 | 7/1975 | DiBuono | 30/90 |
| 4,074,429 | 2/1978 | Roberts | 30/41 |
| 4,562,644 | 1/1986 | Hitchen | 30/41 |
| 4,642,893 | 2/1987 | Borenstein | 30/90 |
| 4,712,300 | 12/1987 | Hemmeter | 30/41 |
| 4,974,319 | 12/1990 | Maguire et al. | 30/41 |
| 5,042,658 | 8/1991 | Tiramani et al. | 30/90 |

*Primary Examiner*—Richard K. Seidel
*Assistant Examiner*—Paul M. Heyrana, Sr.
*Attorney, Agent, or Firm*—Don W. Weber

[57] ABSTRACT

A holder for a safety razor is presented which also contains a sponge reservoir. The sponge reservoir is at one end of the holder and contains lubricating fluids within the sponge and reservoir. At the other end of the safety razor holder is a handle end which is slotted. A safety razor is placed in the holder by placing the razor blade head end in the sponge reservoir and the razor handle into the holder handle slot. When the blade of the safety razor is pressed into the lubricating sponge, the fluid keeps the blade relatively free of the corrosive effects of oxidation of the air, debris from shaving or other dulling factors. The blade may be lubricated by pressing it against the lubricated sponge as needed. The effect of using the safety razor holder is to keep blades sharper, to provide smoother and more comfortable shaves, and to allow the user to apply an appropriate amount of lubricating or softening oils to the razor blade.

2 Claims, 2 Drawing Sheets

LUBRICATING SAFETY RAZOR HOLDER

BACKGROUND OF THE INVENTION

This invention relates to the field of shaving with a safety razor. More particularly it relates to a new device for holding a safety razor which also serves as a reservoir for lubricating oil.

This invention is for use with the standard safety razor. A safety razor is generally T-shaped having a head and razor blade at one end and a perpendicular longitudinal handle. Safety razors are common throughout the world and there use is well known.

One of the problems encountered in using a safety razor is the dulling of the blade. Another problem with the use of safety razors involves the smoothness of the shave provided. One way for providing a smooth shave is to provide a lubricating oil to the face either through the razor itself or by separate application to the area to be shaved.

The 1986 patent issued to Hitchens involves a lubricant-applying mechanism used in conjunction with a safety razor. The Hitchens device provides a cumbersome yet useful means for applying lubricating oil to the razor end of a safety razor to insure a smoother and more comfortable shave. The instant device provides a holder which is separate and apart from the many types of safety razors now in use. The instant device allows the user to selectively apply an appropriate amount of lubricating oil to the individual safety razor without utilizing the cumbersome, yet effective, means shown in Hitchens.

Other United States patents have described holders for safety razors. However, these holders do not in any way keep the blade sharpened or lubricate the blade as does the instant device. The 1985 safety razor holder design patent issued to Iten (D277,434) as well as the 1988 design patent issued to Pokorny (D294,903) both show a device for holding a safety razor. However, the instant device provides not only an attractive holder for the safety razor but also a means for lubricating the razor and keeping the blade sharp.

If a safety razor is stored in a lubricating fluid when not in use, the dulling of the razor edge due to the corrosive action of elements normally found in water, air, and soaps will not occur as readily. It is an object of this invention to provide a holder for a safety razor which also provides a lubricating fluid to reduce premature dulling of a razor edge. Since the corrosive activity of the air, water or soap contributes greatly to the dulling of the blade, it is a further object of this invention to create a razor holder which will help keep the edge sharpened.

Since the razor and the razor holder may be used as needed or desired by the individual user, this device allows a user to apply the lubricating fluid to a safety razor on the basis of personal preference, as desired. It is a further object of this invention to allow the user to apply individualized amounts of lubricating oil to a safety razor.

Since the safety razor is kept in a lubricating fluid and kept sharper in the instant razor holder, it is a further object of this invention to provide a smoother and closer shave from a safety razor involving fewer cuts and nicks in the process of shaving. This invention also provides longer blade life and thus allows for less frequent replacement of the blade and shaver. Other and further objects of this invention will become obvious upon reading the following Specification.

BRIEF DESCRIPTION OF THE INVENTION

The instant device comprises essentially two parts, an outer razor holder with a sponge reservoir and a sponge. The razor holder is essentially rectangular in shape having a razor handle end and a razor blade end. The razor blade end has an essentially square reservoir which receives the lubricating sponge. The lubricating sponge is shaped irregularly so as to hold the safety razor blade head in place and to keep the safety razor blade in contact with the lubricating fluid. The lubricating fluid is applied as needed to the sponge. The essentially square reservoir has a lip around its perimeter to help keep the head of the safety razor in place when the safety razor is in the safety razor holder.

DETAILED DESCRIPTION OF THE PREFERRED EMBODIMENT

Figure 1:
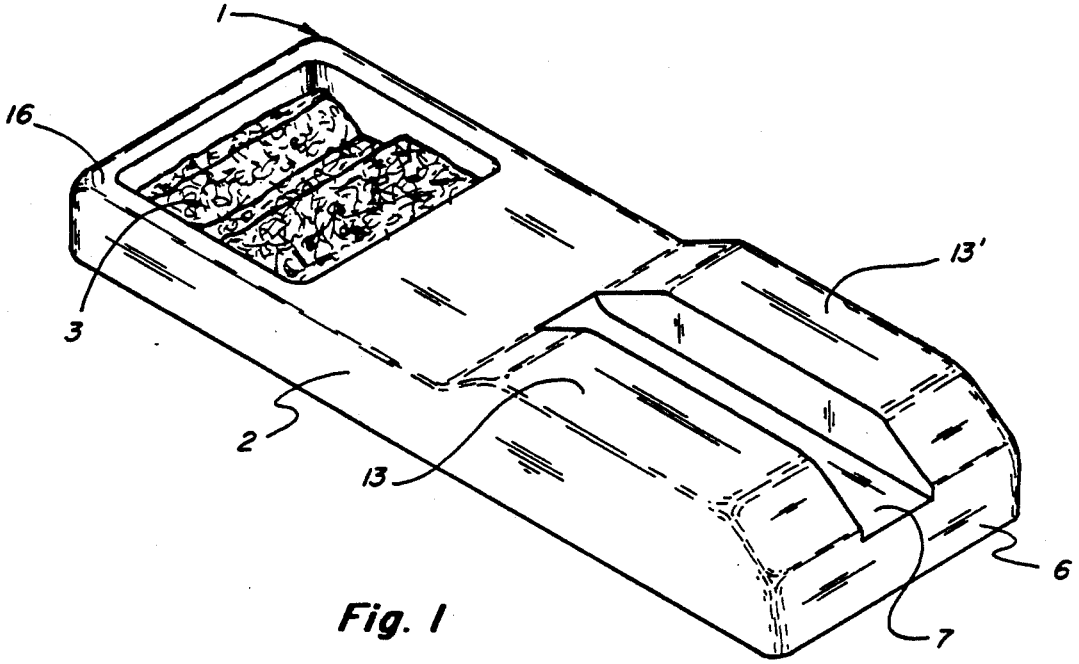
FIG. 1 is a perspective view of the device.

The razor holder 1 is shown generally on FIG. 1. The razor holder 1 comprises an essentially rectangular outer case 2 and an irregularly shaped sponge 3.

Figure 2:
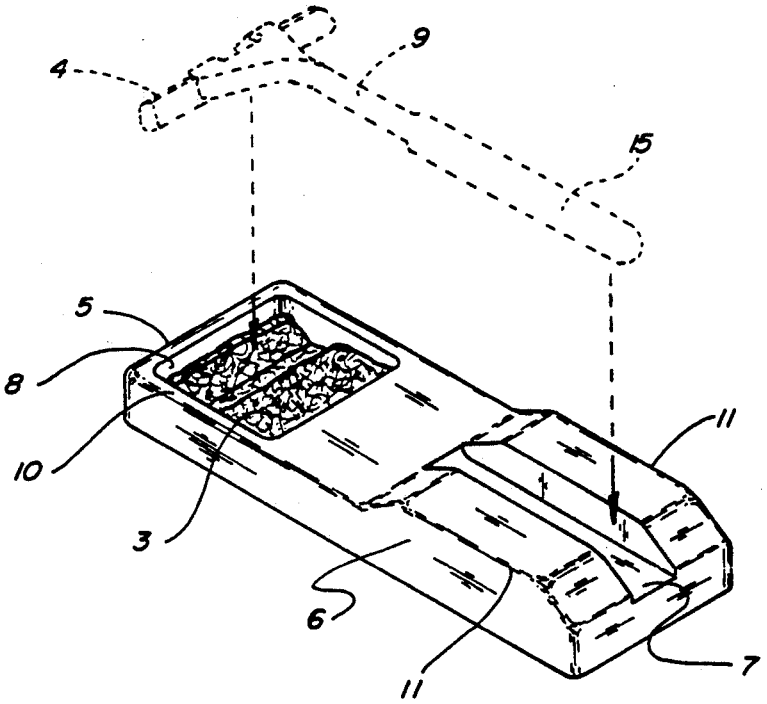
FIG. 2 is a perspective view of the device showing the safety razor in dotted lines.

As best shown on FIG. 2, the standard safety razor is shown. The standard safety razor has a razor head end 4, a neck 9 and a handle 15. This razor head end contains the razor blade and is shaped as shown on FIG. 2, with the head of the razor 4 tilted obliquely from the handle 15. The razor head end 4 is placed into the razor holder 1 by placing the razor head end 4 into the sponge reservoir 8 at the sponge end 5 of the razor holder 1. The handle of the safety razor is then placed in the razor handle end 6 of the razor holder 1.

The razor handle end 6 comprises an elongated handle slot 7 which creates raised blocks 13 and 13' along the handle slot 7.

Figure 3:
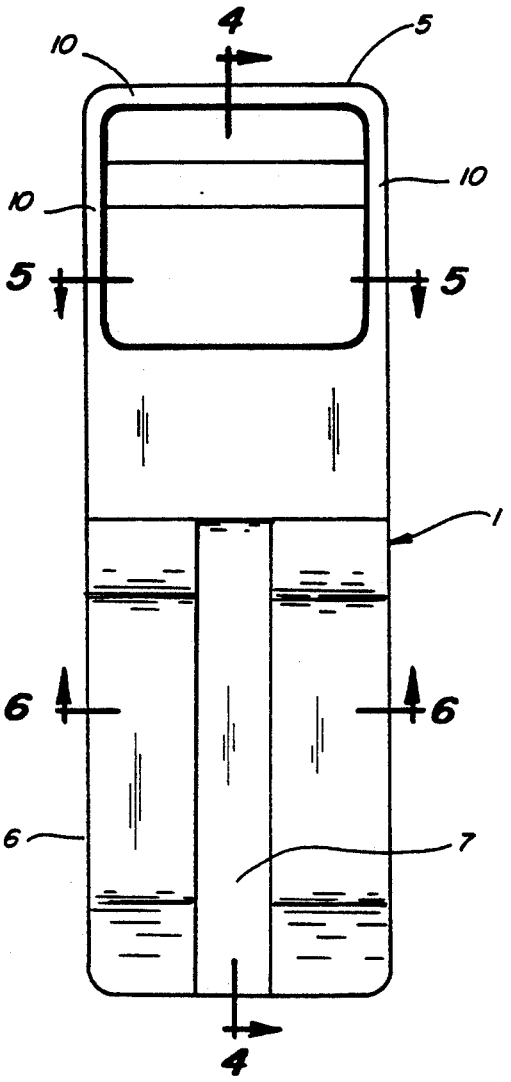
FIG. 3 is a top plane view of the device.
Figure 6:
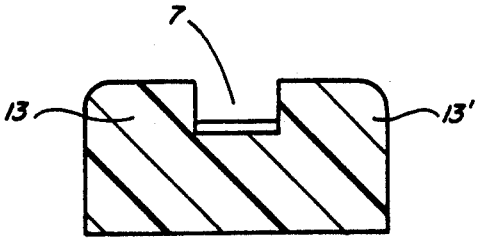
FIG. 6 is a cutaway view of the device taken along lines 6—6 of FIG. 3.
Figure 5:
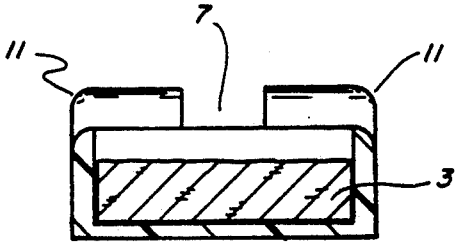
FIG. 5 is a cutaway view of the device taken along lines 5—5 of FIG. 3.

Turning now to FIG. 3 of the drawings, it can be seen that the razor holder 1 has a sponge end 5 and a holder handle end 6. The sponge end 5 has a sponge reservoir 8. This sponge reservoir 8 is best shown on FIG. 4. The sponge reservoir 8 is essentially square when viewed from the top (FIG. 3), and has an essentially rectangular cross section, as shown on FIG. 4. This sponge reservoir 8 is adapted to receive the sponge 3, as shown in FIGS. 4 and 5.

Around the essentially square perimeter of the sponge end 5 of the razor holder is a sponge reservoir lip 10. This lip 10 tends to hold the head of the safety razor in place and in contact with the lubricating sponge 3. This lip 10 extends over the edge of the sponge 3 and reservoir 8 and holds the sponge and safety razor head 4 in place while also providing an attractive appearance. The lip 10 also provides a means for reducing possible spillage of the lubricating fluid.

The slot 7 which is shown best on FIGS. 1, 3, 5 and 6 receives the handle 15 of the safety razor as shown on FIG. 2. The handle 15 of the safety razor is prevented from sliding to the left or right to any great degree by the slot and the raised blocks 13 and 13' at the handle end 6 of the holder. This handle slot 7, in combination with the lip 10 of the sponge reservoir, creates a stable and convenient means for keeping the safety razor in place while the holder is being used to hold the safety razor.

Figure 4:
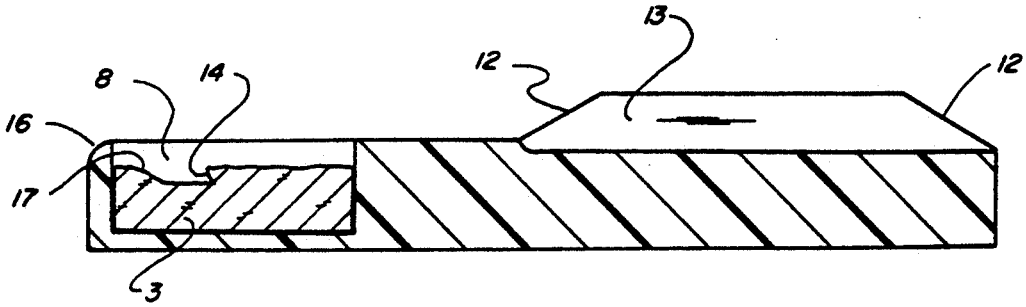
FIG. 4 is a cutaway view of the device taken along lines 4—4 of FIG. 3.

The sponge 3 itself has an irregular shape as best shown on FIG. 4. The purpose of the sponge 3 is multi-faceted. The sponge allows the user to wick water off of the razor head 4 of the safety razor and also may be used to remove soap film or other artifacts which may have accumulated on the blade. The sponge is soaked in lubricating oil so it may also be used to apply lubrication to the blade when the head of the safety razor is placed in contact with the sponge and on top of the sponge 3. The use of the sponge also stabilizes the movement of the lubricating fluid to prevent spilling the fluid.

As can be seen in FIG. 4, the sponge itself has a bevel 14. This bevel 14 helps to stabilize the safety razor head 4 when the razor is placed in the reservoir 8 and handle slot 7 in the safety razor.

The safety razor has a handle end 15 and a slightly angled head end 4 as shown on FIG. 2. The angle of the head of the safety razor 4 with respect to the handle 15 of the safety razor approximates the angle of the sponge bevel 14 shown on FIG. 4. The remaining portion of the sponge slopes irregularly towards the top 16 of the device to provide a surface for wicking the razor or applying lubricating oil. This irregular shape 17 enables the blade of the safety razor to stay in approximate contact with the sponge and lubricating fluid.

The sponge bevel 14 and the irregular shape 17 enable the razor blade to remain in approximate contact with the sponge surface (and hence the lubricating fluid) for continued protection of the blade against corrosion when the razor is not in use. The shape of the sponge bevel 14 also helps to stabilize the safety razor when it is in the safety razor holder and the holder is picked up or moved.

Figure 7:
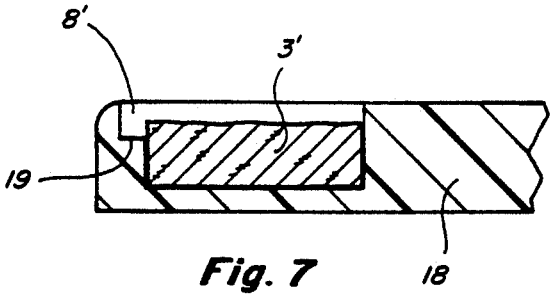
FIG. 7 is a partial cutaway view of an alternate embodiment of the device taken along lines 6—6 of FIG. 3.

An alternate embodiment of the device utilizes a square sponge 3' and a ledge 19 as part of the outer case 2, as shown on FIG. 7. The body 18 of the outer casing has a ledge 19 located in the sponge reservoir as shown on FIG. 7. This ledge 19 is used to hold the head 4 of the razor in place, instead of the irregular shaped surface 17 on the sponge 3. The ledge 19 in the casing takes the place of the irregular surface 17. A rectangular, regularly shaped sponge 3' may then be inserted into the sponge reservoir 8 as shown. The ledge 19 and sponge 3' are used as described above for the alternately shaped sponge 3. The ledge 19 may vary in angle from 0 to 90 degrees with respect to the top surface of the sponge 3'.

The sponge 3 has a thickness which allows complete contact of the shaver head into the sponge and lubricating fluid at the end of use. The sponge is completely replaceable and allows the user to control the application of the appropriate amount of lubricating fluid to the razor.

The razor blade may be lubricated by pressing the blade against the lubricated sponge.

The lubricating fluid itself has a number of qualities which protect the blade from the dulling effects commonly found in the safety razor. The lubricating fluid allows for a smoother more comfortable shave while agents in the lubricating fluid itself can condition the skin for a softer skin result after the shave. Different types of healing or soothing agents can also be added to the fluid (such as aloe and Vitamin E) to aid in healing in the event of any unexpected nicks or scrapes.

The outer edges 11 of the safety razor holder may be textured or otherwise adapted to create a certain friction surface. While these outer edges are generally curved for a pleasing appearance, the cross hatching, burming, or other means of applying a friction surface allow the user to secure a firm grip on the holder should it be necessary for the user to move the holder from one position to another. The ends 12 of the raised blocks 13 and 13' are beveled at an angle to provide a more aesthetic appearance of the holder. However, it is within the contemplation of this invention to have different shapes or designs on the ends 12 of the raised blocks 13 and 13' while still keeping within the contemplation of this invention.

The device described herein may take different shapes or forms while still keeping within the disclosure of the invention. For example, the sponge reservoir 8 need not be square with an essentially rectangular cross-section but may be oval, round, or take different geometric shapes while still remaining within the contemplation of this disclosure. Similarly, the handle slot 7 may be extended or widened in proportion to the width of the razor holder while still keeping within the contemplation of this invention. Also, the lip may be wider than shown in proportion to the other dimensions herein while still keeping within the contemplation of this device.

While the irregular shape of the sponge, as best shown in FIG. 4, is the preferred embodiment of this device, this shape may vary according to manufacturing specifications and minor variations in the exact angle of the bevel 14 of the sponge are still within the contemplation of this device. For example, the sponge bevel 14 may be perpendicular to the top surface of the sponge rather than at an oblique angle.

Other minor variations from the specific details set out by the preferred embodiment herein are still within the contemplation of this device. The sponge end 5 of the device and the sponge reservoir 8 in particular may vary in dimension as long as the reservoir is capable of accepting the head end 4 of a safety razor. The sponge reservoir 8 should be large enough to allow easy insertion of the razor head end 4 of a safety razor. The reservoir 8 and the holder handle end 6 and handle slot 7 should be long enough to accept the handles of all types of safety razors currently in use in the industry. The drawings herein disclose the approximate relative dimensions of the device and the sponge reservoir and sponge.

Having fully disclosed me device I claim:

1. A holder for a safety razor, said razor having a razor head end and a razor handle end, comprising:

(a) a flat, essentially rectangular outer casing, having a sponge reservoir end and a razor handle end, said casing having a length, width and height, wherein said length and width are substantially greater than said height, so that the outer casing is stable when sitting on a surface;

(b) said casing having a sponge reservoir at one end, wherein said sponge reservoir is adapted to receive a sponge;

(c) said casing further comprising a lip around the perimeter of said sponge reservoir, said lip extending over the edge of said sponge reservoir;

(d) said casing further comprising a razor head ledge located in said sponge reservoir beneath said lip adapted to receive the razor head end of a razor;

(e) said casing also having a razor handle end having a slot adapted to receive the handle end of a safety razor;

(f) a removable lubricating sponge located in said sponge reservoir, said sponge including lubricating fluid applied therto;

whereby, said lubricating fluid is retained with said sponge reservoir by said sponge, reservoir and lip; and whereby, a safety razor may be retained in said device when not in use, said razor head remaining in contact with said lubricating fluid, so that the corrosive action of elements normally in contact with a safety razor head will be diminished.

2. A method for lengthening the life and increasing the comfort of use of a safety razor, comprising:

(a) placing a sponge within an outer casing of a razor holder, wherein said holder includes a sponge reservoir for containing lubricating fluid;

(b) applying a lubricating fluid to said sponge;

(c) removably placing the head of a safety razor in contact with said sponge when said razor is not in use;

whereby the corrosive action of elements normally in contact with a safety razor head will be diminished.

* * * * *